US012320623B2

(12) United States Patent
Vestlund et al.

(10) Patent No.: US 12,320,623 B2
(45) Date of Patent: Jun. 3, 2025

(54) FRAGMENTATION WARHEAD AND A METHOD OF MANUFACTURING OF A FRAGMENTATION WARHEAD

(71) Applicant: SAAB AB, Linköping (SE)

(72) Inventors: Johnny Vestlund, Karlstad (SE); Olov Thor, Strängnäs (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 18/256,294

(22) PCT Filed: Dec. 6, 2021

(86) PCT No.: PCT/SE2021/051203
§ 371 (c)(1),
(2) Date: Jun. 7, 2023

(87) PCT Pub. No.: WO2022/131994
PCT Pub. Date: Jun. 23, 2022

(65) Prior Publication Data

US 2024/0035790 A1 Feb. 1, 2024

(30) Foreign Application Priority Data

Dec. 14, 2020 (SE) ..... 2000234-1

(51) Int. Cl.
*F42B 12/32* (2006.01)

(52) U.S. Cl.
CPC ..... *F42B 12/32* (2013.01)

(58) Field of Classification Search
CPC ..... F42B 12/32; F42B 12/00; F42B 12/02; F42B 12/22; F42B 12/20
USPC ..... 102/494, 491, 492
See application file for complete search history.

(56) References Cited

U.S. PATENT DOCUMENTS

| | | | | |
|---|---|---|---|---|
| 791,679 A * | 6/1905 | Edmunds | F42B 12/32 | 102/495 |
| 810,582 A * | 1/1906 | Stout | F42B 12/32 | 102/494 |
| 1,272,984 A * | 7/1918 | Mutro | F42B 12/58 | 102/494 |
| 3,181,465 A * | 5/1965 | Anthony | F42B 30/10 | 102/445 |
| 3,815,504 A * | 6/1974 | Tieben | F42B 12/32 | 102/496 |

(Continued)

FOREIGN PATENT DOCUMENTS

| | | |
|---|---|---|
| EP | 2682708 A2 | 1/2014 |
| GB | 1287637 A | 9/1972 |

OTHER PUBLICATIONS

International Search Report and Written Opinion mailed May 27, 2022 for International Application No. PCT/SE2021/051203, 24 pages.

*Primary Examiner* — Joshua E Freeman
(74) *Attorney, Agent, or Firm* — Sage Patent Group

(57) ABSTRACT

The present invention relates to a fragmentation warhead, including: an inner casing accommodating explosive charge; a fragmentation casing at least partly surrounding the inner casing; and an outer casing arranged outside the inner casing and the fragmentation casing; wherein the inner casing includes a front liner and a rear liner, which are connected to each other and wherein the fragmentation casing comprises a molded casing with integrated metal elements.

13 Claims, 4 Drawing Sheets

(56) References Cited

U.S. PATENT DOCUMENTS 4,016,816 A * 4/1977 Larsson ..... F42B 12/32 102/494
4,303,015 A * 12/1981 Bourlet ..... F42B 12/32 102/492
4,383,468 A * 5/1983 Sie ..... F42B 12/32 264/122
4,493,264 A * 1/1985 Jameson ..... F42B 12/32 102/494
4,524,696 A * 6/1985 Altenau ..... F42B 12/32 102/491
4,644,867 A * 2/1987 Hellner ..... F42B 12/32 102/495
4,781,118 A * 11/1988 Assmann ..... F42B 12/32 102/482
4,882,996 A * 11/1989 Bock ..... F42B 12/32 102/494
4,936,217 A * 6/1990 Hofmann ..... F42B 12/32 102/496
5,189,250 A 2/1993 Shaphyr
5,535,679 A * 7/1996 Craddock ..... F42B 12/32 102/389
5,565,648 A * 10/1996 Lindstadt ..... F42B 12/16 102/478
5,594,197 A * 1/1997 Lindstadt ..... F42B 12/625 102/494
5,979,332 A * 11/1999 Hammer ..... F42B 12/32 102/496
10,352,668 B1 * 7/2019 Hooke ..... F42B 12/74
11,041,704 B1 * 6/2021 Ellis ..... B22F 7/08
2005/0087088 A1 * 4/2005 Lacy ..... F42B 12/32 102/495
2011/0179966 A1 * 7/2011 Dupont ..... F42B 1/024 102/492
2016/0258727 A1 * 9/2016 Bruno ..... F42B 12/24
2016/0349027 A1 * 12/2016 Kerns ..... F42B 33/001
2020/0208951 A1 * 7/2020 Allison ..... F42B 12/32
2020/0340788 A1 * 10/2020 Thuman ..... F42B 12/24
2022/0155046 A1 * 5/2022 Thuman ..... B33Y 80/00
2022/0214149 A1 * 7/2022 Pavier ..... F42C 1/10
2023/0132848 A1 * 5/2023 Griffiths ..... F42B 12/32 102/495

* cited by examiner

FRAGMENTATION WARHEAD AND A METHOD OF MANUFACTURING OF A FRAGMENTATION WARHEAD

CROSS-REFERENCE TO RELATED APPLICATIONS

This application is a 35 U.S.C. § 371 national stage application for International Application No. PCT/SE2021/051203, entitled "A FRAGMENTATION WARHEAD AND A METHOD OF MANUFACTURING OF A FRAGMENTATION WARHEAD", filed on Dec. 6, 2021, which claims priority to Swedish Patent Application No. 2000234-1, filed on Dec. 14, 2020, the disclosures and contents of which are hereby incorporated by reference in their entireties.

TECHNICAL FIELD

The invention relates to a fragmentation warhead. The invention also relates to a round comprising such a warhead and a method of manufacturing a warhead. More specifically, the invention relates to a fragmentation warhead configured to be fired from a firearm, such as a barrel or launcher.

BACKGROUND

Warheads with fragmentation capacity, also called fragmentation warheads, are commonly known today and are characterized in that the casing of the warhead is shattered by the detonation of the explosive charge. There are different types of fragmentation warheads and the most common solution comprises a casing/housing with preformed fragments. The casing may thus comprise a surface with a pattern of projections and grooves, wherein, when the explosive charge is ignited and detonated, the grooves are fractured and the projections (fragments) are projected outwardly. Such a warhead is disclosed in document U.S. Pat. No. 9,738,948.

Another type of fragmentation warhead comprises an outer metal casing and a rubber matrix with metal balls, which is pressed into the outer casing. The warhead is subsequently filled with an explosive charge. Typically, conventional x-ray is used when manufacturing warheads to control that the explosive charge has been correctly filled inside the warhead and thus that there are no defects in the explosive charge after filling. Defects in the explosive charge may result in adiabatic compression at launch, which could have serious consequences, so this quality control of the explosive charge may be crucial. However, in a warhead with a pre-mounted rubber matrix, the metal balls in the rubber matrix will make it impossible to use conventional x-ray to control the explosive charge after filling.

Yet another type of fragmentation warhead comprises an inner core with explosive charge and an outer casing, wherein metal balls and adhesive is filled into a gap formed between the inner core and the outer casing after the inner core has been filled with the explosive charge. This way, conventional x-ray can be used to ensure a correct filling of the explosive charge before adding the metal balls. However, filling metal balls and adhesive into the gap is a complicated and time-consuming process, which impedes the manufacturing process and increases costs.

SUMMARY

Despite known solutions in the field, it would be desirable to develop a fragmentation warhead and a method for manufacturing a fragmentation warhead, which alleviates or at least reduces drawbacks with prior art.

An object of the present invention is to achieve a new and advantageous fragmentation warhead, which is safer and has an increased probability of hitting targets. Another object of the present invention is to achieve a new and advantageous fragmentation warhead, which is less time consuming to manufacture. Another object of the present invention is to achieve a new and advantageous method for manufacturing a fragmentation warhead, which is safer and less time consuming.

The herein mentioned objects are achieved by a fragmentation warhead, a round comprising such a fragmentation warhead and a method for manufacturing a fragmentation warhead.

Hence, according to an aspect of the present invention, a fragmentation warhead is provided, the fragmentation warhead comprising: an inner casing accommodating an explosive charge; a fragmentation casing at least partly surrounding the inner casing; and an outer casing arranged outside the inner casing and the fragmentation casing; wherein the inner casing comprises a front liner and a rear liner, which are connected to each other and wherein the fragmentation casing comprises a molded casing with integrated metal elements.

According to another aspect of the present invention, a round is provided, the round comprising a warhead as disclosed herein, wherein the round further comprises: a fuse unit connected to the rear liner of the warhead; a cartridge with propellant, the cartridge being connected to the warhead and; a primer for igniting the propellant.

According to yet another aspect of the present invention, a method of manufacturing a fragmentation warhead is provided, the method comprising: manufacturing an inner casing for accommodating an explosive charge, wherein the inner casing comprises a front liner and a rear liner configured to be connected to each other, filling the inner casing with an explosive charge; manufacturing a fragmentation casing, wherein the fragmentation casing comprises a molded casing with integrated metal elements; manufacturing an outer casing; and assembling the warhead by mounting the fragmentation casing outside the inner casing filled with the explosive charge and mounting the outer casing outside the fragmentation casing.

As previously described, different types of fragmentation warheads are available today and they are manufactured in different ways. For example, filling a warhead comprising metal balls with explosive charge will prevent quality control of the explosive charge inside the warhead. With the fragmentation warhead according to the present disclosure, the fragmentation casing is a separate molded casing with integrated metal elements. The fragmentation casing can thus be manufactured separately and is a self-supported casing, which can be mounted over the inner casing after the inner casing has been filled with explosive charge. This will facilitate manufacturing and will also allow quality control of the explosive charge inside the inner casing. Thus, with this fragmentation warhead, the inner casing may be manufactured and filled with explosive charge, where after a quality control of the explosive may be performed.

Today, fragmentation warheads are typically subject to high pressure testing as part of the manufacturing process to ensure safety. Such testing may be performed at specific testing sites and is performed in order to make sure that the warhead does not have defects, which may cause hot propellant gases to be lead into the explosive charge during launch/projection. Since the inner casing according to the present invention is not exposed to high pressures during launch/projection, it does not have to be subject to high pressure testing. With no testing requirement, manufacturing of the inner casing is facilitated and can be performed at any location and expensive transportation to testing sites is avoided. The warhead according to the present disclosure, with three separate casings, enables high pressure testing of only the parts of the warhead that are in fact exposed to high pressure during launch/projection. Furthermore, by having an inner casing, a fragmentation casing and an outer casing according to the present disclosure, the warhead is divided into different casings/parts/units, which each can be controlled separately. This way, one may be able to statistically calculate the probability of the total defects of the casings leading to hot propellant gases being lead to the explosive charge. If the probability is low, the high pressure testing may not be required at all to ensure safety.

The warhead according to the present disclosure further enables parallel manufacturing processes of the casings and when all separate parts are manufactured, assembly of the warhead can be performed. During assembly, the fragmentation casing is mounted outside the inner casing filled with the explosive charge and the outer casing is mounted outside the fragmentation casing. The assembly of the warhead can this way be performed in fewer steps, which is easier and more cost efficient.

Further objects, advantages and novel features of the present invention will become apparent to one skilled in the art from the following details, and also by putting the invention into practice. Whereas examples of the invention are described below, it should be noted that it is not restricted to the specific details described. Specialists having access to the teachings herein will recognise further applications, modifications and incorporations within other fields, which are within the scope of the invention.

BRIEF DESCRIPTION OF THE DRAWINGS

For better understanding of the present invention and further objects and advantages of it, the detailed description set out below should be read together with the accompanying drawings, in which the same reference notations denote similar items in the various diagrams, and in which.

DETAILED DESCRIPTION

Figure 1A:
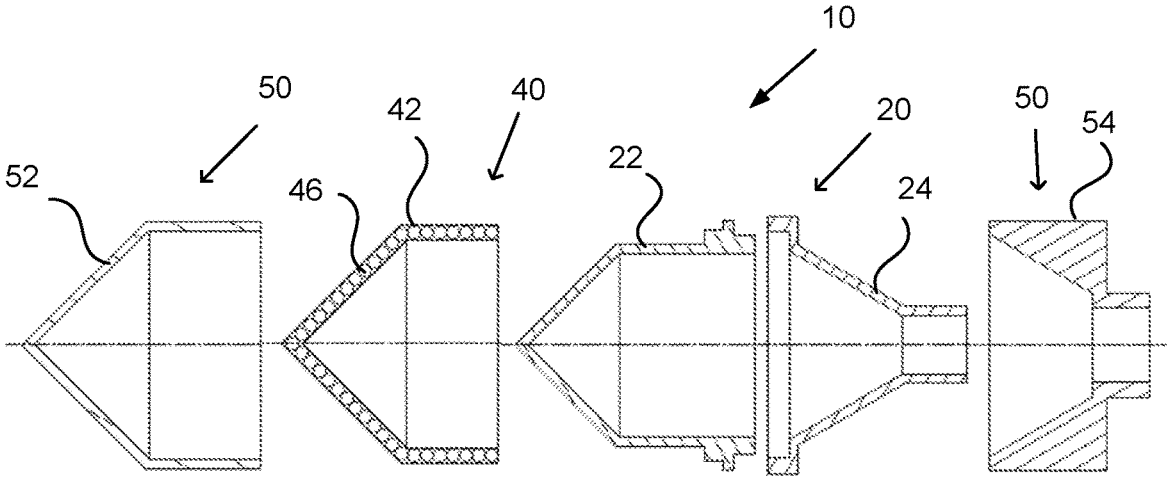
FIG. 1*a-b* schematically illustrates exploded cross-section views of a fragmentation warhead according to examples.

To facilitate manufacturing and achieve a safer and more cost efficient fragmentation warhead, a fragmentation warhead, a round comprising such warhead and a method of manufacturing a warhead according to the disclosure has been developed.

Hence, according to an aspect of the present disclosure, a fragmentation warhead is provided. The fragmentation warhead comprises an inner casing accommodating an explosive charge; a fragmentation casing at least partly surrounding the inner casing; and an outer casing arranged outside the inner casing and the fragmentation casing; wherein the inner casing comprises a front liner and a rear liner, which are connected to each other and wherein the fragmentation casing comprises a molded casing with integrated metal elements.

Within the technical field of warheads, projectiles, shots, bullets, grenades and similar, some words may have different meaning depending on country or company. For clarity, warhead is in this disclosure defined as the component accommodating the explosive charge. A warhead, with and/or without a fuse unit, may also be referred to as a shell. The warhead together with a fuse unit is herein defined as a projectile. Furthermore, the warhead together with the fuse unit as well as a cartridge with propellant and a primer for igniting the propellant is herein defined as a round.

The fragmentation warhead will from now on be referred to as the warhead. The warhead may be configured to be fired from a firearm, such as a barrel or launcher. The warhead may be a spin-stabilized warhead to be used in a rifled barrel.

The front liner and the rear liner of the inner casing may be connected to form a cavity for the explosive charge. The front liner and the rear liner of the inner casing may be configured to be screwed together. The front liner may comprise a first end and a second end. The first end may be hemispherically or conically shaped and the second end may comprise a rear opening. The rear liner may comprise a first end and a second end, wherein the first end comprises a front opening configured to be connected to the rear opening of the front liner. The first end of the rear liner may have a larger diameter than the second end of the rear liner. The rear liner may have be tapering from the first end towards the second end. Thus, the rear liner may have a decreasing diameter from the first end towards the second end. The front liner and the rear liner of the inner casing may comprise metal, such as aluminium.

The front liner and the rear liner may each comprise a connection section to be connected with each other and thereby connect the front liner and the rear liner. The connection section of the front liner may be arranged at the second end of the front liner. The connection section of the front liner may be arranged on the outside of the second end. The connection section of the front liner may extend radially outwardly of the rest of the front liner. Thus, the connection section of the front liner may protrude circumferentially around the second end of the front liner. The connection section of the front liner may comprise outer threads. The connection section of the rear liner may be arranged at the first end of the rear liner. The connection section of the rear liner may comprise inner threads. The connection section of the rear liner may have a larger outer diameter than the second end of the front liner. Thus, the connection section of the rear liner may extend radially outwardly of the rest of the rear liner. Thus, the connection section of the rear liner may protrude circumferentially around the first end of the rear liner. The connection section of the rear liner may extend radially beyond the connection section of the front liner. The front liner and the rear liner may be screwed together.

The inner casing may further comprise a sealing arranged between the front liner and the rear liner. The sealing may thus be arranged between the connection section of the front liner and the connection section of the rear liner. The sealing may be a conventional O-ring or similar. When the front liner and the rear liner are connected, the cavity formed by the two liners can be filled with explosives via the rear inlet of the rear liner.

The fragmentation casing comprising a molded casing with integrated metal elements means that the fragmentation casing is a separate casing, which is self-supported. The fragmentation casing can thus be manufactured separately and independently of the other components of the warhead. The metal elements integrated in the fragmentation casing may be spherical metal balls. The metal elements may have a uniform shape.

According to an example, the fragmentation casing comprises a front member arranged outside the front liner of the inner casing. The front member may thus abut the front liner. The front member may have a similar shape as the front liner of the inner casing. The front member may not cover the connection section of the front liner. Suitably, the front member is arranged so that the connection section of the front liner is uncovered. According to another example, the fragmentation casing comprises a front member arranged outside the front liner of the inner casing, and a rear member arranged outside the rear liner of the inner casing. The rear member may thus abut the rear liner. The rear member may surround at least a part of the rear liner. The rear member may have an essentially annular shape. The rear member may be arranged, such that the connection section of the rear liner is uncovered by the rear member of the fragmentation casing. The fragmentation casing may thus comprise two separate parts. The front member and the rear member of the fragmentation casing may each be molded members with integrated metal elements. The front member and the rear member of the fragmentation casing may be molded separately. By means of the rear member of the fragmentation casing, integrated metal elements will be directed rearwards from the warhead when the explosive charge is ignited and detonated. Thus, metal elements will be directed away from the motion direction of the warhead. This way, even if the warhead explodes after having passed the target, the target may be hit. The fragmentation casing according to this example will thus increase the hit efficiency.

According to an example, the outer casing comprises a nose part arranged outside the front liner and an aft part arranged outside the rear liner. The nose part may have a similar shape as the front liner of the inner casing and the front member of the fragmentation casing. In the event that the fragmentation casing comprises a front member and a rear member, the nose part of the outer casing may be arranged outside the front member and the aft part of the outer casing may be arranged outside the rear member of the fragmentation casing. The outer casing may comprise metal, such as aluminium, steel or magnesium, and/or a polymer matrix composite.

The outer casing may be connected to the inner casing. More specifically, the outer casing may be connected to the connection sections of the inner casing. The nose part may be connected to the connection section of the front liner and the aft part may be connected to the connection section of the rear liner. The nose part may be connected to the second end of the front liner by means of a threaded connection and/or the aft part may be connected to the first end of the rear liner by means of a threaded connection. The connection section of the front liner and the connection section of the rear liner may thus each comprise threads for connection with the outer casing. In this example, the connection sections of the inner casing may not be covered by the outer casing. Alternatively, the nose part and the aft part may be connected to each other. In this event, the outer casing covers the connection sections of the inner casing. The nose part and the aft part may be connected to each other by means of a screw-threaded connection, by means of a snap fit connection or similar.

According to an example, the fragmentation casing comprises an injection molded plastic casing with integrated metal elements. Thus, the fragmentation casing may be an injection molded plastic casing with integrated metal elements. By injection molding the fragmentation casing, a higher density of metal elements in the casing can be achieved. This increases the hit efficiency of the warhead. The fragmentation casing may comprise a plastic material, which is resistant to propellant gas. The fragmentation casing may comprise a plastic material, which is suitable for injection molding. The fragmentation casing may comprise a plastic with low viscosity, such as polypropylene or similar.

According to an example, the fragmentation casing is adhered to the inner casing. Thus, the front member and the optional rear member of the fragmentation casing may be adhered to the inner casing. The front member of the fragmentation casing may thereby be adhered to the front liner of the inner casing. The rear member may be adhered to the rear liner of the inner casing. Alternatively, the rear member may be adhered to the aft part of the outer casing before being mounted over the rear liner of the inner casing.

According to an example, the rear liner comprises a rear inlet for filling of explosive charge. The warhead may further comprise a disc arranged to close said rear inlet when the inner casing is filled with the explosive charge. This way, the explosive charge is retained inside the inner casing. The rear inlet of the rear liner may be arranged at the second end of the rear liner. The rear inlet of the rear liner may thus be arranged opposite the front opening of the rear liner. The disc may be adhered to the second end of the rear liner. The disc may be adhered to a stop shoulder/surface extending inwardly of the circumferential walls of the rear liner. The stop shoulder/surface may encircle the rear inlet. The stop shoulder/surface may extend in parallel with the extension of the disc and/or perpendicularly to the circumferential walls of the rear liner.

The rear liner of the inner casing may comprise a threaded section. In one example, the rear liner of the inner casing comprises a threaded section for connection with a fuse unit. The threaded section may be arranged at the second end of the rear liner. The threaded section may be arranged in association with the rear inlet of the rear liner. The threaded section may surround the rear inlet. The threaded section may extend beyond the rear inlet. The threaded section may have an essentially cylindrical shape. The threaded section may further be used to connect a transportation plug to the second end of the rear liner during manufacturing, in order to secure the disc. The rear liner may thus comprise a threaded section to be used both for connecting a fuse unit and for connecting a transportation plug. Thus, when the disc has been adhered at the rear inlet, the transportation plug may be screwed into the threaded section of the rear liner. The transportation plug may thereby be arranged, such that it abut the disc and thereby presses the disc against the stop shoulder/surface of the rear liner. The transportation plug may be arranged to apply a pressure on the disc until the adhesive used to attach the disc has cured. The transportation plug will this way ensure that the disc is held in place during for example manufacturing and transportation of the inner casing filled with explosive charge. Without the transportation plug, vibrations and temperature changes may affect the disc, such that the disc detaches from the rear liner and the inner casing with explosive charge would have to be rejected/disposed. The transportation plug may be removed before assembly of the warhead. The transportation plug may be removed before the fuse unit is to be connected to the warhead. The disc may not be removed before the fuse unit is to be connected to the warhead, since the fuse unit may be powerful enough to allow the fuse detonation through the disc.

The metal elements of the fragmentation casing may comprise a heavy metal. A heavy metal is a metal with relatively high density, atomic weight or atomic number. According to an example, the metal elements of the fragmentation casing comprises Wolfram. Wolfram may also be referred to as Tungsten.

According to an aspect of the present disclosure, a round comprising a warhead as disclosed herein is provided. The round further comprises: a fuse unit connected to the rear liner of the warhead; a cartridge with propellant, the cartridge being connected to the warhead and; a primer for igniting the propellant. The round may be referred to as a firearm ammunition. When the primer ignites the propellant, the warhead with the fuse unit (also called projectile) is launched/projected away from the cartridge and when the warhead is at desired position in relation to a target to be hit, the fuse unit ignites the explosive charge and the warhead explodes and is fragmented.

According to another aspect of the present disclosure, a method of manufacturing a fragmentation warhead is provided. The method comprises: manufacturing an inner casing for accommodating an explosive charge, wherein the inner casing comprises a front liner and a rear liner configured to be connected to each other; filling the inner casing with an explosive charge; manufacturing a fragmentation casing comprising a molded casing with integrated metal elements; manufacturing an outer casing; and assembling the warhead by mounting the fragmentation casing outside the inner casing filled with explosive charge and mounting the outer casing outside the fragmentation casing.

It is to be understood that all the different examples and variants of the warhead aspect as disclosed herein are applicable on the method aspects. By means of the method of manufacturing a warhead according to the present disclosure, manufacturing of the different casings can be performed in parallel process steps and can thus be performed at different locations/manufacturing sites. Once the different casings are manufactured, and the inner casing has been filled with the explosive charge, the assembly step can be performed in an easy and time efficient way.

Manufacturing the inner casing may comprise manufacturing the inner casing by means of lathing/turning/machining/additive manufacturing. Thus, the front liner and/or the rear liner may be manufactured by means of lathing/turning/machining/additive manufacturing. Alternatively, manufacturing the inner casing may comprise casting the front liner and the rear liner.

The step of filling the inner casing with an explosive charge may comprise to connect the front liner and the rear liner, such that they form a cavity for the explosive charge. The second end of the front liner and first end of the rear liner may be connected. The front liner and the rear liner may be screwed together. Alternatively, the front liner and the rear liner may be connected by means of a snap fit connection. The step of filling the inner casing with an explosive charge may also comprise filling the inner casing with an explosive charge via a rear inlet of the rear liner.

The step of manufacturing the fragmentation casing comprises molding a casing with integrated metal elements. The step of manufacturing the outer casing may comprise manufacturing the outer casing by means of lathing/turning/machining/additive manufacturing. Alternatively, the outer casing is manufactured by means of casting. The step of manufacturing the outer casing may also comprise high pressure testing of the outer casing.

Manufacturing the fragmentation casing may comprise injection molding plastic. The fragmentation casing may thus comprise an injection molded plastic casing with integrated metal elements. Manufacturing the fragmentation casing may comprise injecting a molten plastic material with relatively low viscosity into a mold with the metal elements. This way, the fragmentation casing (front member and optional rear member) will comprise more metal elements and the metal elements will be more evenly distributed within the casing. This will increase the hit efficiency of the warhead.

The method may also comprise arranging a disc to close the rear inlet of the rear liner when the inner casing is filled with the explosive charge. The disc may be adhered to the rear liner to close the rear inlet. The method may further comprise securing the disc by connecting a transportation plug to a threaded section of the rear liner, wherein the transportation plug is removed before mounting the outer casing during the assembly step. The transportation plug may thus be connected to the rear liner by screwing the transportation plug into the threaded section of the rear liner. The transportation plug may be arranged such that it abuts and applies a pressure on the disc.

In one example, the fragmentation casing comprises a front member and a rear member and the outer casing comprises a nose part and an aft part, wherein assembling the warhead comprises adhering the front member on the front liner, adhering the rear member inside the aft part of the outer casing and subsequently arranging the nose part of the outer casing outside the front member and the aft part including the rear member outside the rear liner.

The step of assembling the warhead may comprise connecting the nose part and the aft part of the outer casing to the inner casing. The step of assembling the warhead may comprise connecting the nose part and the aft part of the outer casing to the connection sections of the front liner and the rear liner respectively. The nose part and the aft part may be connected to the inner casing by means of a screw-threaded connection. Alternatively, the nose part and the aft part are connected to each other, for example by means of a screw-threaded connection or a snap fit connection.

The present disclosure will now be further illustrated with reference to the appended figures.

Figure 1B:
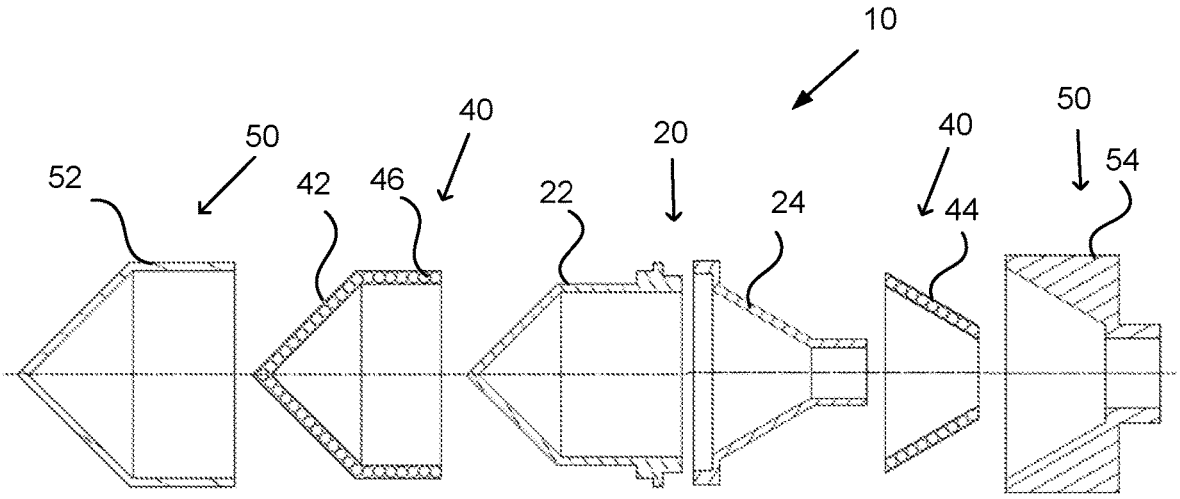

FIG. 1*a-b* schematically illustrate exploded cross-section views of a fragmentation warhead 10 according to examples. The fragmentation warhead 10 comprises: an inner casing 20 accommodating an explosive charge (not shown); a fragmentation casing 40 at least partly surrounding the inner casing 20; and an outer casing 50 arranged outside the inner casing 20 and the fragmentation casing 40. The inner casing 20 comprises a front liner 22 and a rear liner 24, which are connected to each other, and the fragmentation casing 40 comprises a molded casing with integrated metal elements 46. The fragmentation casing 40 is a separate casing, which is self-supported. The fragmentation casing 40 can thus be manufactured separately and independently of the other components of the warhead 10.

FIG. 1*a* shows an example of the fragmentation warhead 10 where the fragmentation casing 40 comprises a front member 42 configured to be arranged outside the front liner 22 of the inner casing 20. The front member 42 may have a similar shape as the front liner 22. FIG. 1*b* shows an example of the fragmentation warhead 10 where the fragmentation casing 40 comprises a front member 42 and a rear member 44. The front member 42 is configured to be arranged outside the front liner 22 and the rear member 44 is configured to be arranged outside the rear liner 24 of the inner casing 20. The rear member 44 may have a similar shape as the rear liner 24. The rear member 44 may have an essentially annular shape. The rear member 44 may have an essentially conical shape. The inner casing 20 is further described with regard to FIG. 2.

The front member 42 and the rear member 44 of the fragmentation casing 40 may each be molded members with integrated metal elements 46. The front member 42 and the rear member 44 may be molded separately. By means of the rear member 44 of the fragmentation casing 40, integrated metal elements 46 will be directed rearwards from the warhead 10 when the warhead 10 explodes. Thus, metal elements will be directed away from the motion direction of the warhead 10. This way, even when the warhead 10 explodes after having passed the target, the target may be hit. The fragmentation casing 40 according to the example shown in FIG. 1*b* will thus increase the hit efficiency of the warhead 10.

The outer casing 50 may comprise a nose part 52 arranged outside the front liner 22 and an aft part 54 arranged outside the rear liner 24. The nose part 52 is arranged outside the front member 42 of the fragmentation casing 40. In the example shown in FIG. 1*b*, the aft part 54 of the outer casing 50 is arranged outside the rear member 44 of the fragmentation casing 40. The outer casing 50 may comprise metal, such as aluminium.

Figure 2:
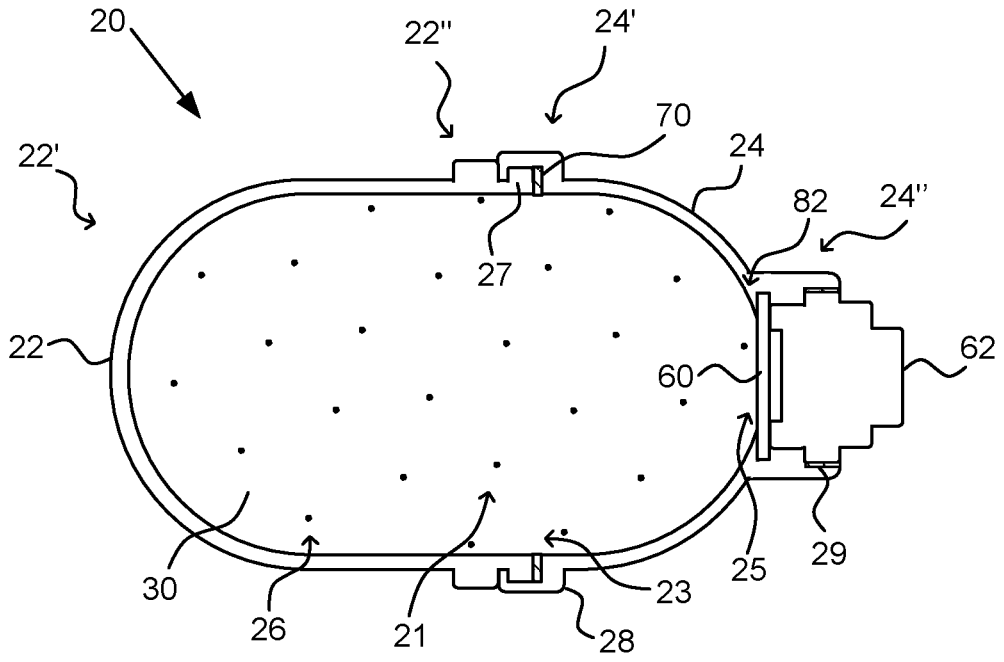
FIG. 2 schematically illustrates details of a fragmentation warhead according to an example.

FIG. 2 schematically illustrates details of a fragmentation warhead 10 according to an example. The fragmentation warhead 10 may be configured as disclosed in FIGS. 1*a-b*. FIG. 2 shows a cross-sectional view of the inner casing 20 filled with the explosive charge 30. The front liner 22 and the rear liner 24 of the inner casing 20 are connected to form a cavity 26 for the explosive charge 30.

The front liner 22 and the rear liner 24 of the inner casing 20 may be configured to be screwed together. The front liner 22 may comprise a first end 22' and a second end 22". The first end 22' may be hemispherical or conical and the second end 22" may comprise a rear opening 21. The rear liner 24 may comprise a first end 24' and a second end 24". The first end 24' may comprise a front opening 23. The second end 22" of the front liner 22 and the first end 24' of the rear liner 24 may be connected with each other. The second end 24" of the rear liner 24 may comprise a rear inlet 25 for filling of the explosive charge 30.

The first end 24' of the rear liner 24 may have a larger diameter than the second end 24" of the rear liner 24. The rear liner 24 may thus have an essentially conical shape. The second end 22" of the front liner 22 may comprise a connection section 27 and the first end 24' of the rear liner 24 may comprise a connection section 28. The connection section 27 of the front liner 22 and the connection section 28 of the rear liner 24 are configured to be connected with each other and thereby connect the front liner 22 and the rear liner 24. The connection section 27 of the front liner 22 may be arranged at the second end 22" of the front liner 22. The connection section 27 of the front liner 22 may extend on the outside of the second end 22". The connection section 27 of the front liner 22 may comprise outer threads. The connection section 28 of the rear liner 24 may be arranged at the first end 24' of the rear liner 24. The connection section 28 of the rear liner 24 may extend radially outwardly of the connection section 27 of the front liner 22. The connection section 28 of the rear liner 24 may comprise inner threads. The connection section 28 of the rear liner 24 may have a larger outer diameter than the second end 22" of the front liner 22. The front liner 22 and the rear liner 24 may thus be screwed together. The front liner 22 and the rear liner 24 of the inner casing 20 may comprise metal, such as aluminium.

The inner casing 20 may further comprise a sealing 70 arranged between the front liner 22 and the rear liner 24. The sealing 70 may thus be arranged between the connection section 27 of the front liner 22 and the connection section 28 of the rear liner 24. The sealing 70 may be a conventional O-ring or similar.

The warhead 10 may further comprise a disc 60 arranged to close the rear inlet 25 of the rear liner 24 when the inner casing 20 is filled with the explosive charge 30.

The disc 60 thus covers the rear inlet 25. This way, the explosive charge 30 is retained inside the cavity 26 of the inner casing 20. The disc 60 may be adhered to the second end 24" of the rear liner 24. The disc 60 may be adhered to a stop shoulder/surface of the rear liner 24.

The rear liner 24 of the inner casing 20 may comprise a threaded section 29 for connection with a fuse unit. The threaded section 29 of the rear liner 24 may be arranged at the second end 24" of the rear liner 24. The threaded section 29 may be arranged in association with the rear inlet 25 of the rear liner 24. The threaded section 29 may be used for connection with a fuse unit (see FIG. 4) when being part of a round/firearm ammunition. The threaded section 29 may additionally or alternatively be used to connect a transportation plug 62 to the second end 24" of the rear liner 24 during manufacturing, in order to secure the disc 60. This is illustrated in these figures. Thus, when the disc 60 has been adhered to the rear liner 24 at the rear inlet 25, the transportation plug 62 may be screwed into the threaded section 29 of the rear liner 24. The transportation plug 62 may be arranged, such that it abuts the disc 60 and thereby presses the disc 60 against the stop shoulder 82 of the rear liner 24. The transportation plug 62 may be arranged to apply a pressure on the disc 60 until the adhesive used to attach the disc 60 has cured. The transportation plug 62 will this way ensure that the disc 60 is held in place during for example manufacturing and transportation of the inner casing 20 filled with the explosive charge 30. The threaded section 29 of the rear liner 24 may thus have dual purposes/functions, one during manufacturing/transportation, and one when the warhead 10 is used in a round (see FIG. 4).

Figure 3:
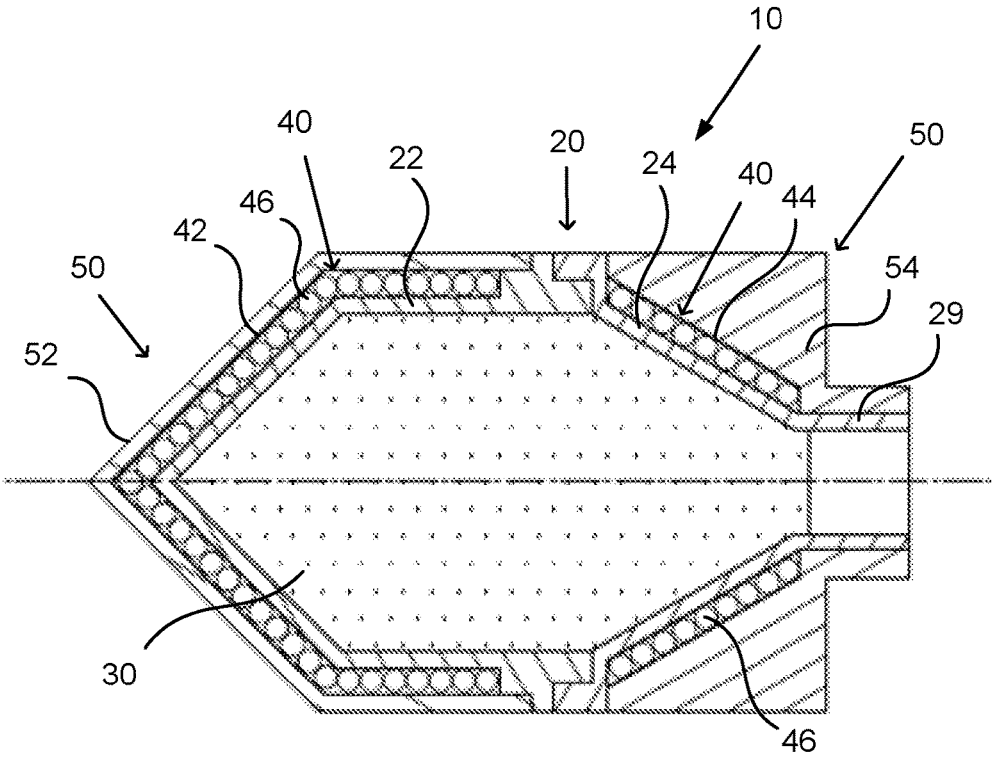
FIG. 3 schematically illustrates a cross-section view of a fragmentation device according to an example.

FIG. 3 schematically illustrates a cross-section view of a fragmentation warhead according to an example. The fragmentation warhead 10 may be configured as disclosed in FIG. 1*a-b* and may comprise components as illustrated in FIG. 2.

FIG. 3 shows the fragmentation warhead 10 when it has been assembled and is ready to be used in a round. The fragmentation casing 40 may be an injection molded plastic casing with integrated metal elements 46. By injection molding the fragmentation casing 40, a higher density of metal elements 46 in the fragmentation casing 40 is achieved. This higher density of metal elements 46 increases the hit efficiency of the warhead 10. The fragmentation casing 40 may comprise a plastic material, which is resistant to propellant gas. The fragmentation casing 40 may comprise a plastic with low viscosity, such as polypropylene or similar.

FIG. 3 shows the front liner 22 and the rear liner 24 of the inner casing 20 connected to each other. The fragmentation casing 40 comprises a front member 42 and a rear member 44 in this example, wherein the front member 42 is adhered to the front liner 22 of the inner casing 20. The rear member 44 may be adhered to the rear liner 24 of the inner casing 20. Alternatively, the rear member 44 may be adhered to the aft part 54 of the outer casing 50 before being mounted outside/over the rear liner 24 of the inner casing 20. The rear liner 24 may comprises a threaded section 29 at the rear end 24" of the rear liner 24. The threaded section 29 and/or the rear end 24" of the rear liner 24 suitably extends through and beyond (rearwardly) the rear member 44 of the fragmentation casing 40. Thus, the rear member 44 of the fragmentation casing 40 may not surround the threaded section 29. The aft part 54, however, may surround the rear member 44 of the fragmentation casing 40 and the whole rear liner 24, including the threaded section 29.

The metal elements 46 integrated in the fragmentation casing 40 may be spherical metal balls. The metal elements 46 may have a uniform shape. The metal elements 46 may comprise a heavy metal. According to an example, the metal elements 46 of the fragmentation casing 40 comprises Wolfram. Wolfram may also be referred to as Tungsten.

The nose part 52 may be connected to the second end 22" of the front liner 22 by means of a threaded connection and/or the aft part 54 may be connected to the first end 24' of the rear liner 24 by means of a threaded connection. The nose part 52 may alternatively be connected to the second end 22" of the front liner 22 by adhesion and/or the aft part 54 may be connected to the first end 24' of the rear liner 24 by means of adhesion. The nose part 52 may be connected to the connection section 27 of the front liner 22 and the aft part 54 may be connected to the connection section 28 of the rear liner 24. In this example, the nose part 52, the aft part 54, the connection section 27 of the front liner 22 and the connection section 28 of the rear liner 24 may together form the outer surface of the warhead 10. The connection section 27 of the front liner 22 and the connection section 28 of the rear liner 24 may thus be flush with the outer surface of the nose part 52 and the aft part 54. Alternatively, the nose part 52 and the aft part 54 of the outer casing 50 may be connected to each other by means of a screw-threaded connection, by means of a snap fit connection or similar. In this case, the nose part 52 and the aft part 54 together form the outer surface of the warhead 10.

Figure 4:
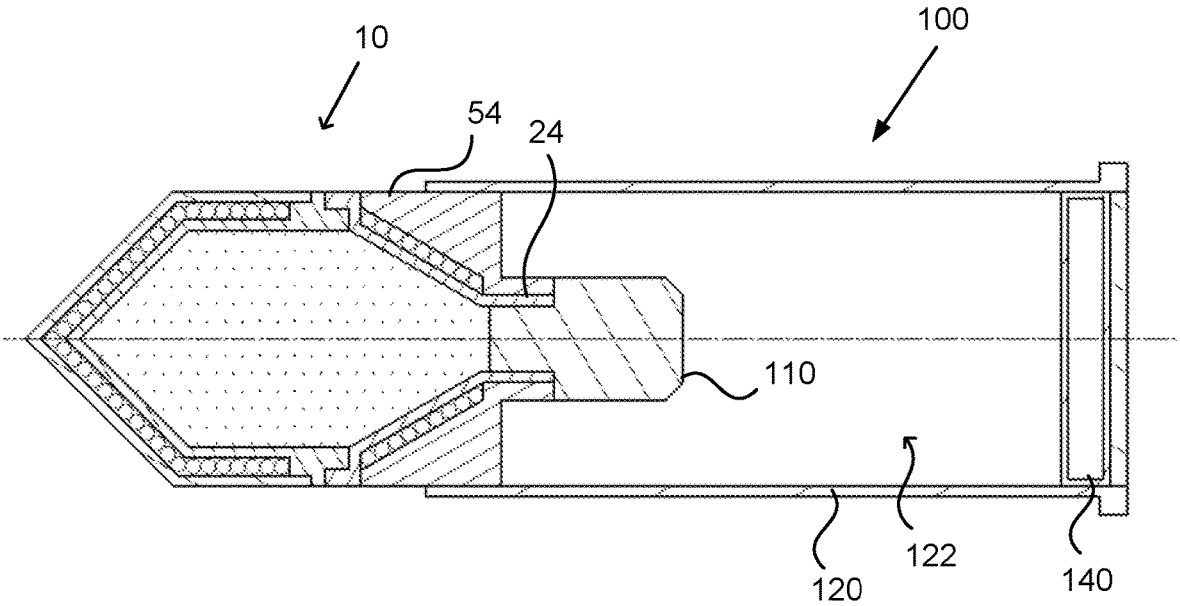
FIG. 4 schematically illustrates a cross-section view of a round according to an example.

FIG. 4 schematically illustrates a cross-section view of a round 100 according to an example. The round 100 comprises a warhead 10 as disclosed in FIGS. 1*a-b*, 2 or 3. The round 100 further comprises a fuse unit 110 connected to the rear liner 24 of the warhead 10; a cartridge 120 with propellant 122, the cartridge 120 being connected to the warhead 10 and; a primer 140 for igniting the propellant 122. The cartridge 120 may be connected to the warhead 10 via the aft part 54. The round 100 may be referred to as a firearm ammunition.

Figure 5:
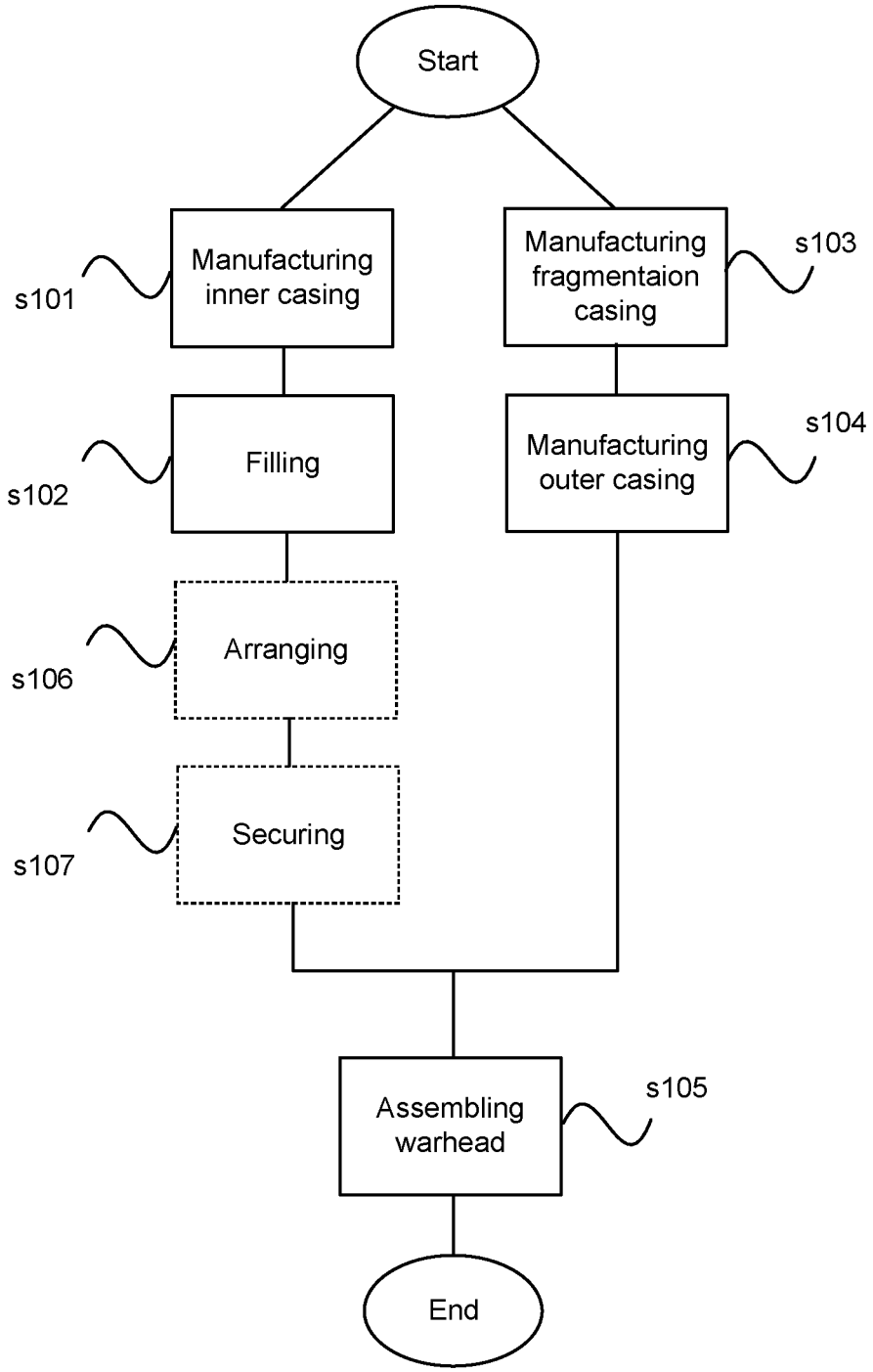
FIG. 5 schematically illustrates a block diagram of a method for manufacturing a fragmentation device according to an example.

FIG. 5 schematically illustrates a block diagram of a method of manufacturing a fragmentation warhead 10 according to an example. The method may relate to a warhead 10 as disclosed in FIG. 1*a-b*, FIG. 2 or FIG. 3. The method comprises: manufacturing s101 an inner casing 20 for accommodating an explosive charge 30, wherein the inner casing 20 comprises a front liner 22 and a rear liner 24 configured to be connected to each other; filling s102 the inner casing 20 with an explosive charge 30; manufacturing s103 a fragmentation casing 40 comprising a molded casing with integrated metal elements 46; manufacturing s104 an outer casing 50; and assembling s105 the warhead 10 by mounting the fragmentation casing 40 outside the inner casing 20 filled with the explosive charge 30 and mounting the outer casing 50 outside the fragmentation casing 40.

In this figure, the method has been illustrated as if the method steps of manufacturing s101 the inner casing 20 and filling s102 the inner casing 20 with the explosive charge 30 are performed simultaneously/in parallel with the method steps of manufacturing s103 the fragmentation casing 40 and manufacturing s104 the outer casing 50. It is, however, to be understood that the method steps of manufacturing s103 the fragmentation casing 40 and manufacturing s104 the outer casing 50 may be performed after or prior to the method steps of manufacturing s101 the inner casing 20 and filling s102 the inner casing 20 with the explosive charge 30. It doesn't matter in which order the manufacturing of the different components is performed as long as all components have been manufactured and the inner casing 20 is filled with the explosive charge 30 before the assembly starts.

The step of manufacturing s101 the inner casing 20 may comprise lathing/turning/machining/additive manufacturing. Thus, the front liner 22 and/or the rear liner 24 may be manufactured by means of lathing/turning/machining/additive manufacturing. Alternatively, manufacturing s101 the inner casing 20 may comprise casting the front liner 22 and the rear liner 24.

The step of filling s102 the inner casing 20 with an explosive charge 30 may comprise to connect the front liner 22 and the rear liner 24, such that they form a cavity 26 for the explosive charge 30. The front liner 22 and the rear liner 24 may be screwed together. Alternatively, the front liner 22 and the rear liner 24 may be connected by means of a snap fit connection. The step of filling s102 the inner casing 20 with an explosive charge 30 may also comprise filling the inner casing 20 with an explosive charge 30 via the rear inlet 25 of the rear liner 24.

The step of manufacturing s103 the fragmentation casing 40 comprises molding the fragmentation casing 40 with integrated metal elements 46. The step of manufacturing s103 the fragmentation casing 40 may comprise injection molding plastic. Manufacturing s103 the fragmentation casing 40 may comprise injecting a molten plastic material with relatively low viscosity into a mold with the metal elements 46. This way, the fragmentation casing 40 will comprise more metal elements 46 and the metal elements 46 will be more evenly distributed within the fragmentation casing 40. This will increase the hit efficiency of the warhead 10.

The step of manufacturing s104 the outer casing 50 may comprise manufacturing the outer casing 50 by means of lathing/turning/machining/additive manufacturing. Alternatively, the outer casing 50 is manufactured by means of casting. The step of manufacturing s104 the outer casing 50 may also comprise high pressure testing of the outer casing 50.

The method may also comprise arranging s106 a disc 60 to close the rear inlet 25 of the rear liner 24 when the inner casing 20 is filled with the explosive charge 30. The disc 60 may be adhered to the rear liner 24 to close/cover the rear inlet 25.

The method may further comprise securing s107 the disc 60 by connecting a transportation plug 62 to a threaded section 29 of the rear liner 24, wherein the transportation plug 62 is removed before mounting the fuse unit 110 during the assembly step s105. The transportation plug 62 may be connected to the rear liner 24 by screwing the transportation plug 62 into the threaded section 29 of the rear liner 24. The transportation plug 62 may be arranged such that it abuts and applies a pressure on the disc 60.

The step of assembling s105 the warhead 10 may comprise adhering the front member 42 of the fragmentation casing 40 on the front liner 24 of the inner casing 20. The step of assembling s105 the warhead 10 may comprise adhering the rear member 44 of the fragmentation casing 40 on the rear liner 24 of the inner casing 20. The step of assembling s105 the warhead 10 may comprise arranging the nose part 52 of the outer casing 50 outside the front member 42 of the fragmentation casing 40 and the aft part 54 of the outer casing 50 outside the rear member 44 of the fragmentation casing 40.

The step of assembling s105 the warhead 10 may comprise adhering the front member 42 of the fragmentation casing 40 on the front liner 24 of the inner casing 20, adhering the rear member 44 of the fragmentation casing 40 inside the aft part 54 of the outer casing 50 and subsequently arranging the nose part 52 of the outer casing 50 outside the front member 42 of the fragmentation casing 40 and the aft part 54 of the outer casing 50 including the rear member 44 of the fragmentation casing 40 outside the rear liner 24 of the inner casing 20.

The step of assembling s105 the warhead 10 may comprise connecting the nose part 52 and the aft part 54 of the outer casing 50 with the inner casing 20. The step of assembling s105 the warhead 10 may comprise connecting the nose part 52 and the aft part 54 of the outer casing 50 with the connection sections 27, 28 of the front liner 22 and the rear liner 24 respectively. Alternatively, the step of assembling s105 the warhead 10 may comprise connecting the nose part 52 and the aft part 54 of the outer casing 50 with each other, by means of a screw-threaded connection.

The foregoing description of the preferred embodiments of the present invention is provided for illustrative and descriptive purposes. It is not intended to be exhaustive or to restrict the invention to the variants described. Many modifications and variations will obviously be apparent to one skilled in the art. The embodiments have been chosen and described in order best to explain the principles of the invention and its practical applications and hence make it possible for specialists to understand the invention for various embodiments and with the various modifications appropriate to the intended use.

The invention claimed is:

1. A fragmentation warhead, comprising:
an inner casing accommodating an explosive charge;
a fragmentation casing at least partly surrounding the inner casing; and
an outer casing arranged outside the inner casing and the fragmentation casing;
wherein the inner casing comprises a front liner and a rear liner, which are connected to each other and wherein the fragmentation casing comprises a molded casing with integrated metal elements, wherein the fragmentation casing is a separate casing, which is self-supported,
wherein the rear liner comprises a rear inlet for filling of the explosive charge and the warhead further comprises:
a disc arranged to close said rear inlet when the inner casing is filled with the explosive charge.

2. The warhead according to claim 1, wherein the fragmentation casing comprises a front member arranged outside the front liner of the inner casing, and a rear member arranged outside the rear liner of the inner casing.

3. The warhead according to claim 1, wherein the outer casing comprises a nose part arranged outside the front liner and an aft part arranged outside the rear liner.

4. The warhead according to claim 3, wherein the nose part and the aft part are connected to the inner casing by means of screw threaded connections.

5. The warhead according to claim 1, wherein the fragmentation casing comprises an injection molded plastic casing with integrated metal elements.

6. The warhead according to claim 1, wherein the fragmentation casing is adhered to the inner casing.

7. The warhead according to claim 1, wherein the rear liner of the inner casing comprises a threaded section for connection with a fuse unit.

8. The warhead according to claim 1, wherein the metal elements of the fragmentation casing comprise Wolfram.

9. A round comprising:
a warhead, wherein the warhead comprises:
an inner casing accommodating an explosive charge;
a fragmentation casing at least partly surrounding the inner casing; and
an outer casing arranged outside the inner casing and the fragmentation casing;
wherein the inner casing comprises a front liner and a rear liner, which are connected to each other and wherein the fragmentation casing comprises a molded casing with integrated metal elements, wherein the fragmentation casing is a separate casing, which is self-supported and, wherein the round further comprises:
a fuse unit connected to the rear liner of the warhead;
a cartridge with propellant, the cartridge being connected to the warhead and;
a primer for igniting the propellant,
wherein the rear liner comprises a rear inlet for filling of the explosive charge and the warhead further comprises:
a disc arranged to close said rear inlet when the inner casing is filled with the explosive charge.

10. A method of manufacturing a fragmentation warhead, the method comprising:
manufacturing an inner casing for accommodating an explosive charge, wherein the inner casing comprises a front liner and a rear liner configured to be connected to each other;
filling the inner casing with an explosive charge;
manufacturing a fragmentation casing comprising a molded casing with integrated metal elements, wherein the fragmentation casing is a separate casing, which is self-supported;
manufacturing an outer casing; and
assembling the warhead by mounting the fragmentation casing outside the inner casing filled with explosive charge and mounting the outer casing outside the fragmentation casing,
wherein the rear liner comprises a rear inlet for filling of the explosive charge and the method further comprises:
a disc arranged to close said rear inlet when the inner casing is filled with the explosive charge.

11. The method according to claim 10, wherein the method further comprises:
securing the disc by connecting a transportation plug to a threaded section of the rear liner, wherein the transportation plug is removed before mounting the fuse unit during assembly.

12. The method according to claim 10, wherein the fragmentation casing comprises a front member and a rear member and the outer casing comprises a nose part and an aft part, wherein assembling the warhead comprises adhering the front member on the front liner, adhering the rear member inside the aft part and subsequently arranging the nose part outside the front member and the aft part including the rear member outside the rear liner.

13. The method according to claim 12, wherein the nose part and the aft part are connected to the front liner and the rear liner by means of screw-threaded connections.

* * * * *